US010889906B2

(12) United States Patent
Richard et al.

(10) Patent No.: US 10,889,906 B2
(45) Date of Patent: Jan. 12, 2021

(54) LOW-PROFILE ALUMINUM CELL POTSHELL AND METHOD FOR INCREASING THE PRODUCTION CAPACITY OF AN ALUMINUM CELL POTLINE

(71) Applicant: HATCH LTD., Mississauga (CA)

(72) Inventors: Daniel Richard, Kitimat (CA); Dale Pearen, Milton (CA); John Andrew Ferguson Shaw, Toronto (CA); Bert O. Wasmund, Milton (CA); Maciej Urban Jastrzebski, Mississauga (CA)

(73) Assignee: Hatch Ltd., Mississauga (CA)

( * ) Notice: Subject to any disclaimer, the term of this patent is extended or adjusted under 35 U.S.C. 154(b) by 476 days.

(21) Appl. No.: 15/528,357

(22) PCT Filed: Nov. 20, 2015

(86) PCT No.: PCT/CA2015/051213

§ 371 (c)(1),
(2) Date: May 19, 2017

(87) PCT Pub. No.: WO2016/077932

PCT Pub. Date: May 26, 2016

(65) Prior Publication Data

US 2017/0362725 A1 Dec. 21, 2017

Related U.S. Application Data

(60) Provisional application No. 62/082,898, filed on Nov. 21, 2014.

(51) Int. Cl.

| | |
|---|---|
| ***C25B 15/02*** | (2006.01) |
| ***C25B 9/00*** | (2006.01) |
| ***C25C 3/10*** | (2006.01) |

(52) U.S. Cl.
CPC ..... *C25C 3/10* (2013.01)

(58) Field of Classification Search
CPC .. C25B 15/02; C25B 9/00; C25B 9/06; C25B 9/02; C25B 11/00; C25B 1/04;
(Continued)

(56) References Cited

U.S. PATENT DOCUMENTS

| | | | |
|---|---|---|---|
| 2,861,036 | A | 11/1958 | Simon-Suisse |
| 2,874,103 | A | 2/1959 | Syz et al. |

(Continued)

FOREIGN PATENT DOCUMENTS

| | | | |
|---|---|---|---|
| CA | 2838113 | A1 | 5/2014 |
| WO | 2011028132 | | 3/2011 |
| WO | 2011028132 | A1 | 3/2011 |

OTHER PUBLICATIONS

"Technology Research on Aluminum Reduction Cell Pre-Stressed Shell," Light Metals 2015, pp. 511-515 (Zheng et al, 2015).

(Continued)

*Primary Examiner* — Zulmariam Mendez
(74) *Attorney, Agent, or Firm* — Marshall & Melhorn, LLC

(57) ABSTRACT

An aluminum reduction cell having a shell structure with a pair of longitudinally extending sidewalls, a pair of transversely extending endwalls, a bottom wall, and an open top having an upper edge. The aluminum reduction cell also has a transverse support structure with transverse bottom beams located under the shell structure and extending transversely between the sidewalls, each of the transverse bottom beams having a pair of opposed ends. The aluminium reduction cell also has compliant binding elements fixed to the transverse support structure, each extending vertically along an outer surface of one of the sidewalls for applying an inwardly directed force said sidewall. The compliant binding ele- (Continued)

ments are in the form of cantilever springs. Each spring has a metal member with a lower end which is secured to the transverse support structure, and a compliant, upper free end which is movable inwardly and outwardly in response to expansion and contraction of the shell structure.

25 Claims, 13 Drawing Sheets

(58) Field of Classification Search
CPC .. C25C 3/08; C25C 7/005; C25C 3/06; C25C 3/12; C25C 7/00; C25C 7/02
USPC ..... 204/247
See application file for complete search history.

(56) References Cited

U.S. PATENT DOCUMENTS 3,404,082 A 10/1968 Henkie
3,702,815 A 11/1972 Nikiforov
4,087,345 A 5/1978 Sandvik et al.
4,124,476 A 11/1978 Rapolthy
4,322,282 A * 3/1982 Jemec ..... C25C 3/08 204/247.5
4,421,625 A 12/1983 Fischer et al.
4,912,602 A * 3/1990 Zurek ..... H04B 1/3833 361/752

OTHER PUBLICATIONS

Third Party Observation Regarding International Application No. PCT/CA2015/051213 (Nov. 20, 2015).
International Search Report and Written Opinion Regarding International Application No. PCT/CA2015/051213 (dated Jan. 20, 2016).
Morten Sorlie, Harald A. Oye: "Cathodes in Aluminium Electrolysis", 2010, Aluminum-Verlag Marketing & Kommunikation GmbH, Dusseldorf, XP009505445, ISBN: 978-3-87017-294-7, pp. 71-74, *p. 71, line 22—p. 74, line 10*.
European Patent Office, Supplementary European Search Report with Written Opinion issued in PCT/CA2015/051213, dated Jun. 1, 2018, 7 pages, European Patent Office, Munich, Germany.
Examination and Search Report; UAE Application No. P6000577/2017 dated Jun. 4, 2020.

* cited by examiner

LOW-PROFILE ALUMINUM CELL POTSHELL AND METHOD FOR INCREASING THE PRODUCTION CAPACITY OF AN ALUMINUM CELL POTLINE

CROSS-REFERENCE TO RELATED APPLICATION

This application claims priority to and the benefit of U.S. Provisional Patent Application No. 62/082,898 filed Nov. 21, 2014, the contents of which are incorporated herein by reference.

TECHNICAL FIELD

The present invention relates to a method for increasing the reactive area within an existing potshell footprint to increase the productivity or lower the capital costs/tonne production capacity of an aluminum Hall-Heroult cell potline. In another aspect, the invention relates to an aluminum cell structure and potshell for achieving the same.

BACKGROUND

Aluminum is produced using the electrolytic Hall-Heroult process. Conventional plants utilize hundreds of cells connected in series and housed in a long building or potline, together with the transformers, rectifiers, busbars, cranes, tapping equipment and other ancillaries.

An aluminum cell comprises anodes suspended above a bath of electrolyte overlying a pad of molten aluminum, which acts as the cathode on which metallic aluminum collects. Typically, the anodes are carbon blocks suspended on a moveable beam within a superstructure placed above the bath of electrolyte. The bath and aluminum pad are contained in a refractory lining, including a carbon-based bottom composed of cathode blocks furnished with current collector bars. The lining is housed in a steel tank, termed a potshell, which is protected from the bath by refractory wall blocks. The wall blocks are designed to be cooled by intimate thermal contact with the potshell, which is itself cooled externally by natural or forced convection means. If a sufficiently effective heat transfer exists between the blocks and the shell, a protective lining of frozen electrolyte will form on the interior surface of the blocks thereby preventing them from degrading during operation of the cell.

The Hall-Heroult process is an electrolytic process. The production of aluminum in an aluminum cell is proportional to the current supplied to the cell. It is generally accepted that modern aluminum cells are limited to operating at electrode current densities of approximately 1 A/cm2. As a result, the productivity of an aluminum cell depends on the area of the electrodes, which can be characterized as the area of the cathodes or anodes in the horizontal plane.

The available electrode area for a particular shell is constrained by the internal dimensions of the potshell and, to some extent, the lining design. The internal dimensions of the potshell, on the other hand, are constrained by the size of the potshell structure, the pot-to-pot spacing, and the dimension of surrounding equipment, for example bus bars, support plinths etc.

Early aluminum cells used anthracitic materials for the cathodes. Anthracitic cathodes are known to absorb large quantities of sodium and to generally swell during the course of the aluminum cell campaign. The chemical swelling could, to some extent, be counteracted by the application of large confining forces. As a result, past potshell designs were very strong, so as to reduce the amount of chemical growth of the lining to manageable levels. Modern high amperage cells use graphitized or graphitic materials. These materials exhibit considerably less chemical growth, and so do not need to rely on the same high loads to control growth over the course of a campaign.

The use of graphitic and graphitized cathodes has reduced the demands on modern potshells. However, potshells must still be correctly designed to ensure long life of the lining and robustness against diverse operating conditions.

It is known from the aluminum industry and other pyrometallurgical industries that vessel integrity relies on maintaining at least a minimum required compressive load, termed the minimum binding load, on the lining at all times. The minimum binding load must be maintained during thermal cycles, during which the lining shrinks and grows due to changing operating temperatures. Failure to maintain the minimum binding load can lead to the formation of gaps, potentially resulting in metal infiltration and reduced pot performance or catastrophic tap-out.

Modern potshells use stiff and strong reinforcing structures to reliably achieve minimum required binding loads during thermal cycles. In the transverse direction, known potshell designs typically make use of a plurality of strong vertical supports, located at fixed intervals along the sidewall. These are typically I, double T, or U sections which extend horizontally 300 mm to 500 mm beyond the internal dimensions of the potshell cavity, as illustrated in FIG. 3 (Prior Art) and shown in greater detail in WO2011/028132 A1. For the purpose of the description that follows, this dimension will be referred to as the depth of the potshell structure.

The drawback of existing potshells is that stiff structures experience a large drop in the binding load for a given magnitude of thermal cycle. This necessitates that the structure be designed for a high normal operating load, so that the drop precipitated by a thermal cycle does not result in the compressive load applied to the lining dropping below the minimum binding load.

Others have recognized that using a more compliant structure can produce more predictable lining compression and improve the operational performance and campaign life of a reduction cell.

For example, U.S. Pat. No. 2,861,036 proposed a vat composed of multiple elements and restrained by elastic elements (compliant bindings) in an effort to eliminate the leaks and deformation inherent in the potshells of the time. The proposed design located springs between the cradles and a stiff surrounding support structure. This requires additional space, relative to a more conventional potshell, thereby increasing the external dimension of the aluminum cell. This is a significant drawback, as will be subsequently shown.

U.S. Pat. No. 4,421,625 proposed a similar arrangement to U.S. Pat. No. 2,861,036, modified with upper bracing elements and horizontal stiffeners. As before, the disclosed invention places spring elements between a stiff structural frame and the shell in one embodiment, or outboard of the structural frame in another. This has the same drawback as U.S. Pat. No. 2,861,036.

While otherwise achieving the objective of maintaining the lining under sufficient compressive force, existing potshell designs, and the design alternatives proposed in U.S. Pat. Nos. 2,861,036 and 4,421,625 suffer from the disadvantage of having a large external structure. This structure limits the cathode area that can be accommodated in a cell of given external dimensions.

For example, a potline having 300 aluminum cells equipped with conventional potshells with a pot-to-pot spacing of 6 m, will require a building or buildings approximately 1800 m long. The, vertical support elements, being 300 mm to 500 mm deep, will consume 180 m to 300 m of this building length. This length includes the associated bus work, off-gas ducts, feed conveyor systems, foundations etc. This building length represents a significant proportion of the total cost of a potline, and does not contribute directly to the production of aluminum.

Considerable effort has been devoted by others to the reduction of potshell weight as a means of reducing the cost of installed aluminum smelting capacity. Examples of prior art can be found in U.S. Pat. No. 3,702,815 and "Technology Research on Aluminum Reduction Cell Pre-Stressed Shell" TMS 2015, among others. However, analysis carried out by the inventors shows that for a potshell of a given production capacity, greater overall cost reductions can be achieved with a reduction in the depth of the potshell structure, by allowing for closer pot-to-pot spacing and reducing the length of the building. Similarly, for a potshell of given external dimensions, reduced depth of the potshell structure allows a larger overall electrode area, and hence production capacity, to be installed in a potline of fixed length.

SUMMARY

The following summary is intended to introduce the reader to the more detailed description that follows, and not to define or limit the claimed subject matter.

The object of the present invention is to provide a potshell with compliant bindings and a low-profile or thin potshell design. This is suitable for aluminum reduction cells using graphitic or graphitized cathode blocks and operating at 200 kA or more. The compliant bindings comprising a low-profile sidewall structure with cantilever springs (also referred to herein as cantilever plates) that extends less than about 200 mm beyond the inside of the potshell cavity, and that can maintain the minimum requisite binding loads during thermal cycles, and at all times during the campaign.

Another object of the present invention is to provide a method for increasing the electrode area, and therefore production capacity of a potline of fixed dimensions.

According to one aspect, the invention is a low-profile aluminum cell, comprising a lining and a potshell. The lining is of conventional modern design, using graphitic or graphitized cathodes which are not vulnerable to excessive chemical growth when unconstrained. Furthermore, the low-profile aluminum cell of this invention is suitable for high power operation at 200 kA or more.

According to another aspect, the potshell comprises a shell structure, termed a shoebox, an endwall structure, and a transverse support structure.

According to another aspect, the shoebox is a five-sided, open-topped box, designed to contain the lining of the aluminum cell and having sufficient provision for cathode collector bars, lifting and other functions known to those familiar with aluminum cell design and operation.

According to another aspect, the endwall structure is according to any suitable design, appropriate to withstand the loads arising due to expansion of the lining.

According to another aspect, the transverse support structure comprises a plurality of stiff horizontal bottom beams located below the bottom plate of the shoebox with vertical compliant binding elements mounted at each end of each beam. The bottom beams are designed to withstand the vertical loads from the process and reinforce the shoebox against buckling, and the bending moment applied by the compliant binding elements in response to the expansion of the lining.

According to another aspect, the compliant binding elements comprise vertical members attached to the transverse bottom beams. The compliant binding elements comprise vertical cantilever springs or plates designed to be less stiff than existing potshell vertical structural elements, while achieving the minimum binding load during thermal cycles. The compliant binding elements are designed so as to extend no more than about 200 mm beyond the maximum interior dimensions of the shoebox, over substantially the entire height of the binding element.

The advantage of the present invention is that the more constant load-displacement characteristics of cantilever springs allow the normal operating loads applied to the lining to be reduced, without a decrease in the robustness of the lining or its performance during thermal cycles. The reduction in load requirements allows smaller binding elements to be used without a decrease in cell performance.

The present invention overcomes the limitation of the prior art by reducing the external dimensions of a potshell structure. This allows a larger electrode area to be accommodated in a potshell of given external dimensions. When employed in a potline, the present invention allows higher production capacity to be achieved in a smaller number of cells, or the same capacity to be achieved in a potline with fewer pots as compared to the state of the art.

BRIEF DESCRIPTION OF THE DRAWINGS

In order that the claimed subject matter may be more fully understood, references will be made to the accompanying drawings, in which:

DETAILED DESCRIPTION OF EMBODIMENTS

In the following description, specific details are set out to provide examples of the claimed subject matter. However, the embodiments described below are not intended to define or limit the claimed subject matter. It will be apparent to those skilled in the art that many variations of the specific embodiments may be possible within the scope of the claimed subject matter.

Figure 4:
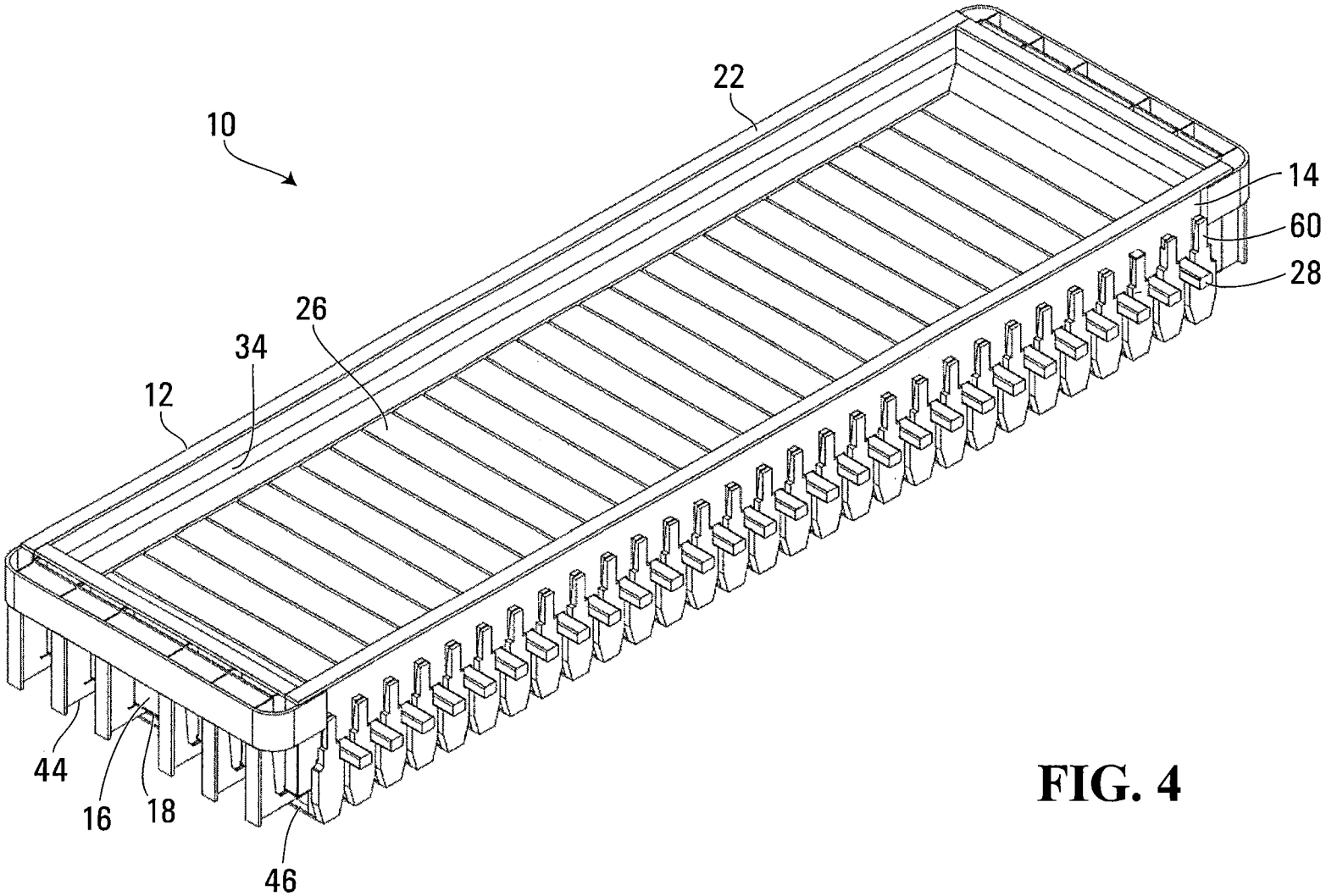
FIG. 4: Potshell according to an embodiment of the invention.
Figure 5:
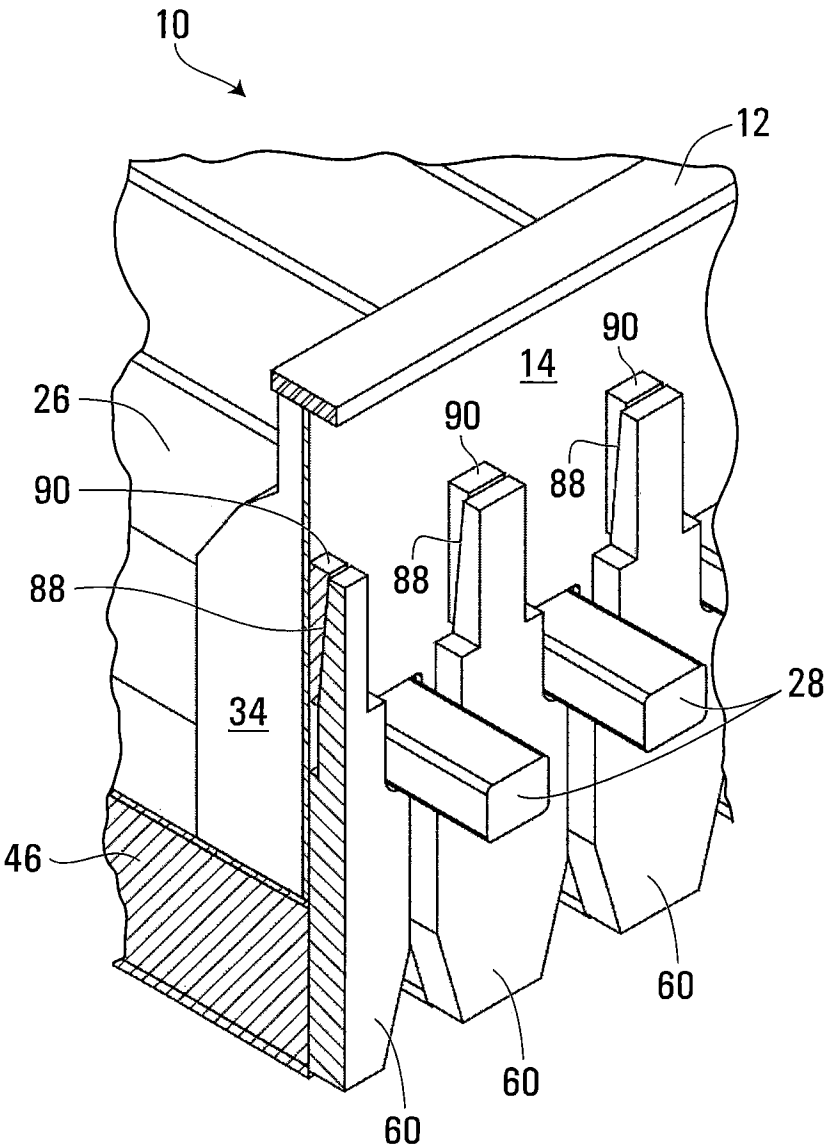
FIG. 5: Enlarged, partial cross-section of potshell of FIG. 4, showing lining and transverse structure.

FIGS. 4 and 5 illustrate an aluminum reduction cell potshell 10 (sometimes referred to herein as "reduction cell 10" or "potshell 10") according to an embodiment, with some of the components thereof eliminated for clarity, and located in a single reduction cell bay. It will be understood by the reader that the potshell 10 may be furnished with a support structure, superstructure, collector bars, and bus bars in order to produce aluminum by the Hall-Heroult process. These elements, being common to reduction cells, are omitted from the following description unless needed for clarity of the content specific to the embodiment.

The reduction cell potshell 10 comprises a shell structure 12 (also referred to herein as a "shoebox 12") comprising a pair of longitudinally extending sidewalls 14, a pair of transversely extending endwalls 16, a bottom wall 18, and an open top having an upper edge 22 about its perimeter. As shown, the shell structure 12 is substantially rectangular in shape, with the sidewalls 14 being longer than the endwalls 16.

The sidewalls 14 and endwalls 16 of potshell 10 are protected from the bath by refractory wall blocks 34 lining their inner surfaces. The bottom wall 18 is lined with a carbon-based bottom composed of graphitic or graphitized cathode blocks 26 (of a type not prone to excessive long-term chemical growth) furnished with current collector bars 28, the ends of which extend through the sidewalls 14.

When a plurality of reduction cells 10 are combined to form a potline (not shown), the reduction cells 10 are lined up beside each other, each in their respective reduction cell bay, with the sidewalls 14 of adjacent reduction cells 10 in parallel, opposed relation to one another. The potline is housed within an enclosure (not shown) having a length and a width, with the sidewalls 14 of the reduction cells 10 extending across the width of the enclosure and the endwalls 16 of the reduction cells 10 extending along the length of the enclosure. The enclosure is typically a building with a width sufficient to accommodate a single potline.

Figure 6:
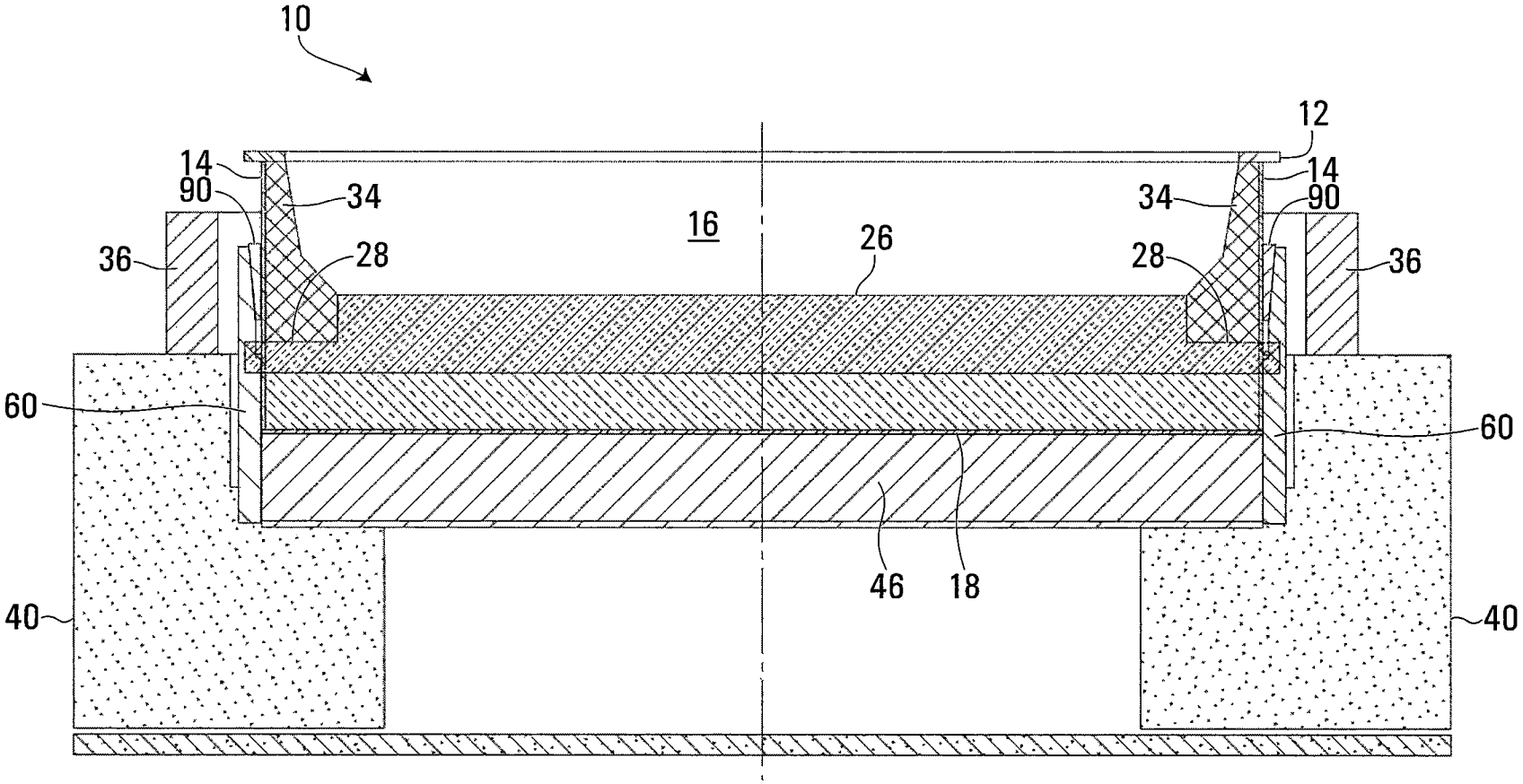
FIG. 6: Transverse cross-section of potshell of FIG. 4.
Figure 7:
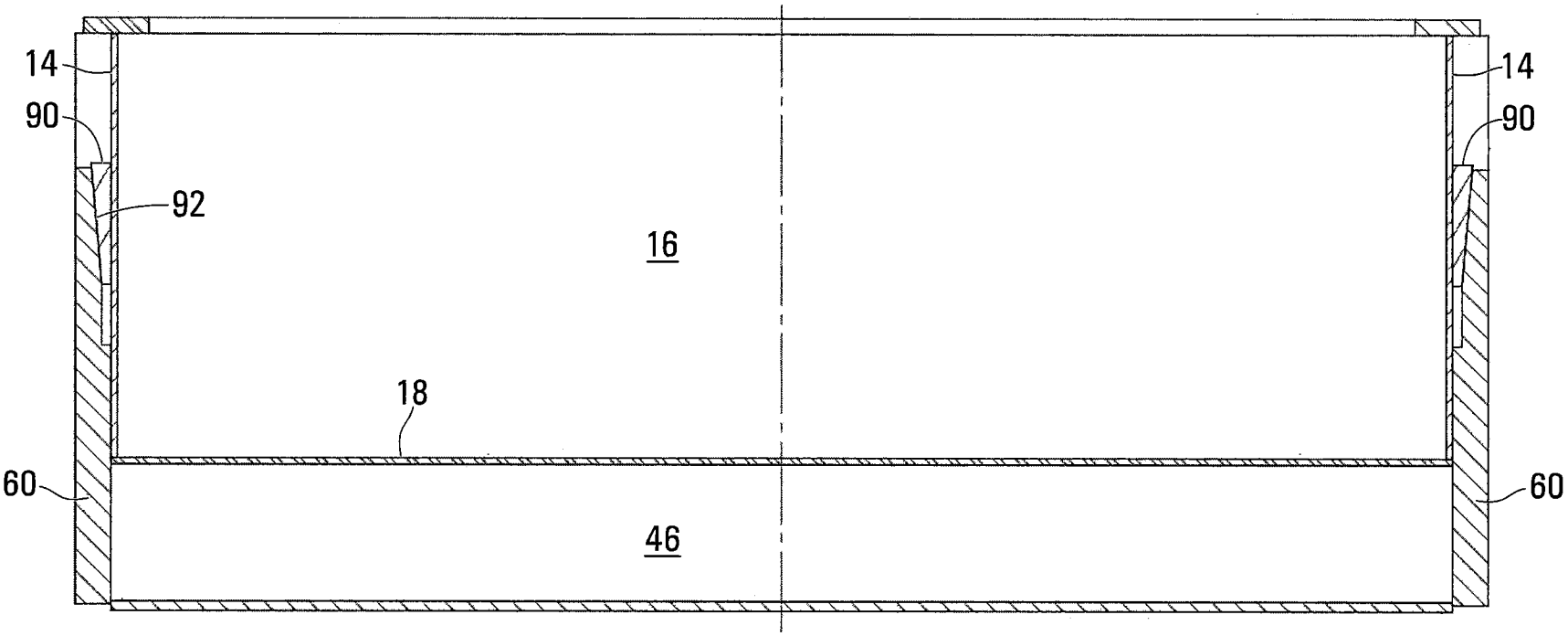
FIG. 7: Transverse cross-section of transverse bottom beams and compliant binding elements of the potshell of FIG. 4, including a first type of adjustment means.
Figure 8:
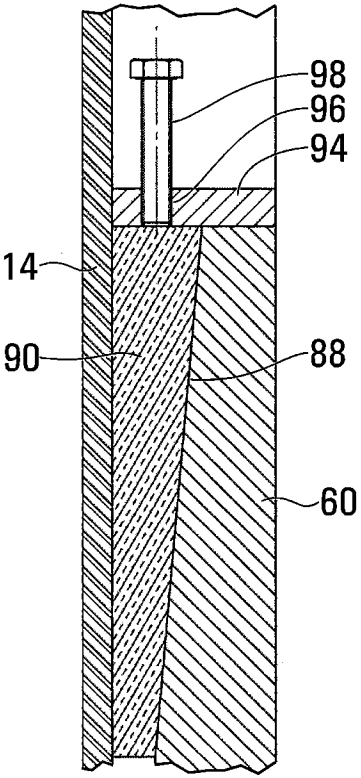
FIG. 8: Enlarged view of one of the compliant binding elements and adjustment means of FIG. 7.

Each reduction cell bay further comprises one or more longitudinal busbars (not shown in FIG. 4) extending along each of the sidewalls 14, and one or more transverse busbars extending along each of the endwalls 16. The longitudinal busbars 36 (FIG. 6) are conductively connected to the ends of the current collector bars 28 of the cathode blocks 26. The longitudinal busbars are spaced from the sidewalls 14 and the transverse busbars are spaced from the endwalls 16, forming a defined envelope in which the potshell 10 resides. The arrangement of the bus bars in the embodiment shown in FIG. 4 will have the same appearance and structure as the bus bars shown in prior art FIG. 1.

The shell structure 12 and its contents are supported on a base structure 40 which includes a plurality of stiff, horizontally extending, transverse bottom beams 46 extending substantially parallel to endwalls 16, and may also comprise a plurality of stiff, horizontally extending, longitudinal bottom beams 44 extending parallel to sidewalls 14. The bottom beams 44, 46 (also referred to herein as "support members") are located below the bottom wall 18 of the shell structure 12 and may form a criss-crossing network of horizontal support beams to support the weight of the reduction cell 10 and its contents.

The transverse bottom beams 46 together define a transverse support structure. As can be seen from the drawings, the transverse bottom beams 46 are located almost entirely underneath the shell structure 12, and the ends of the transverse bottom beams 46 do not substantially extend beyond the sidewalls 14 of the shell structure 12. Thus, the transverse bottom beams 46 do not add significantly to the footprint of the reduction cell 10.

The endwalls 16 are furnished with an endwall reinforcement, known as an endwall structure, to supply the reaction forces necessary in the longitudinal direction. The endwall structure is of any suitable conventional design, and is not described herein in detail.

In addition to the transverse bottom beams 46, the transverse support structure comprises a plurality of compliant binding elements, described below, which are connected to the transverse bottom beams 46.

The transverse support structure comprising the plurality of stiff horizontal transverse bottom beams 46 is located below the bottom wall 18 of the shoebox 12. The transverse bottom beams 46 are designed to withstand the vertical loads; namely the weight of the shoebox 12 and its contents and maintenance loads that are applied to the structure. The transverse bottom beams 46 also reinforce the shoebox 12 against buckling, and the bending moment applied by the compliant binding elements in response to the expansion of the lining, which includes the refractory wall blocks 34 and the cathode blocks 26.

The potshell 10 further comprises a plurality of compliant binding elements 60 (also referred to herein as "vertical binding elements 60"), each extending vertically along the outer surface of one of the sidewalls 14 of the shell structure 12, i.e. in the space between one of the sidewalls 14 and an adjacent longitudinal busbar. Thus, it can be seen that the vertical binding elements 60 are located substantially within the outer perimeter of the reduction cell 10, and do not contribute significantly to the footprint of the reduction cell 10.

Each of the vertical binding elements 60 has a lower end which is secured to the transverse support structure, and more specifically is rigidly secured to one of the transverse bottom beams 46. For example, as shown in FIGS. 4 and 5, each of the vertical binding elements 60 is rigidly secured to an end of one of the transverse bottom beams 46.

Each of the vertical binding elements 60 has an opposite upper end or free end, which is located at or below the upper edge 22 of the shell structure 12. Thus, the vertical binding elements 60 do not add to the height of the potshell 10. For example, the upper ends of the vertical binding elements 60 may be located below the upper edge 22 of the shell structure 12, and may be located at substantially the same level as the upper surfaces of cathode blocks 26.

Each of the vertical binding elements 60 may comprise a vertical cantilever spring or cantilever plate comprising a metal member, which may comprise a metal plate, attached at its lower end to one of the transverse bottom beams 46. The cantilever springs are of sufficient length so that the main point of load transfer to the shoebox 12 is at approximately the elevation of the top of the cathode blocks 26, as mentioned above.

The thickness, width and composition of the metal members are selected such that the free upper end of each vertical binding element 60 is compliant, such that it is outwardly movable in response to thermal and/or chemical outward dilation of the shell structure 12, and inwardly movable in response to a thermal contraction of the shell structure 12, while maintaining an inwardly directed compressive force on the shell structure 12. For example, the thickness and/or width of the vertical binding elements 60 may be varied along the length of the vertical binding element 60. As shown in the drawings, for example, the upper ends of the vertical binding elements 60 may be reduced in width and/or thickness as compared to the lower ends, such that the upper ends are more compliant than the lower ends.

The compliant binding elements 60 may be designed so that during normal operation they are at a first load, termed the operating load, so that in response to an expected reduction in process temperature (thermal cycle), the associated shrinkage of the lining does not cause a reduction in the applied load below a second load, termed the minimum binding load.

The minimum binding load may be defined as the load at which the calculated frictional and other forces opposing the contraction of the lining are overcome, thereby preventing the formation of gaps in the lining during contraction in response to the thermal cycle.

The thermal cycle may be defined as a departure from the normal operating temperature, consistent with the limits of normal current aluminum cell operating practice, typically in the range +/−100-150° C. of the normal operating temperature.

Figure 12:
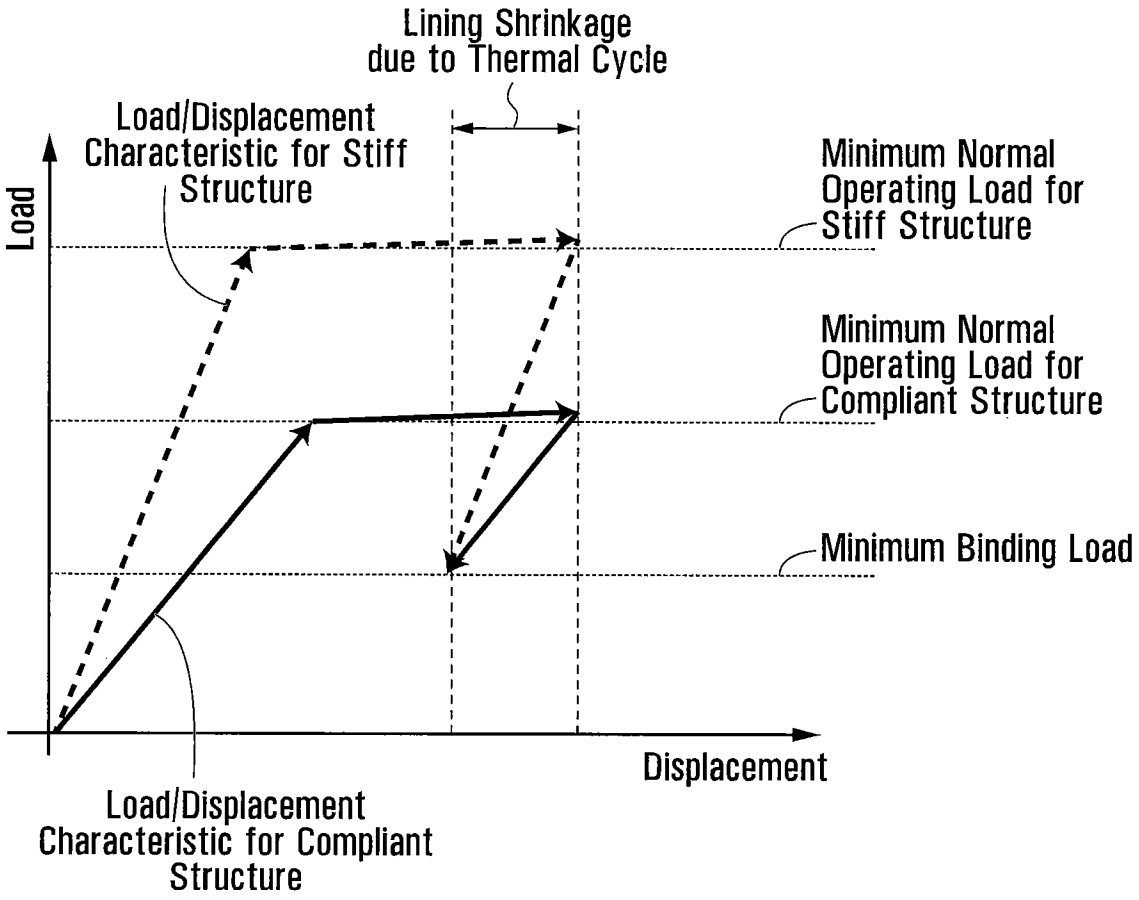
FIG. 12: Schematic representation showing load-displacement behavior of a potshell.

The advantage of the present embodiment is that increased compliance of the structure, provided by vertical binding elements 60 in the form of cantilever springs, reduces the load that must be developed during normal operation to maintain the minimum binding load during a thermal cycle. This relies on the fact that the less stiff a structure is, the less the reaction load changes when it is deflected. This is illustrated in FIG. 12, which shows the load-displacement characteristics for a stiff structure, and a compliant one. Although both structures maintain the minimum binding load during a thermal cycle, the stiff structure needs a substantially higher operating load to do so.

The cantilever spring of the compliant binding element 60 may be designed using sizes and materials of construction (typically mild or low-alloy steels) so that it deforms principally within the plastic range of the materials of construction above the design operating load. The materials of construction are selected so as have sufficient ductility to accommodate the expected thermal and chemical growth of the lining, as calculated based on the expansion properties of the lining materials or estimated from operating experience. Stronger materials can be selected for the compliant binding elements 60 to reduce their size and increase the elastic range, if desired.

The sizes of the vertical binding element 60 may be selected to be no more than about 200 mm in depth (thickness), to maximize the advantages obtained from the invention. This can be seen, for example, by comparing the cross-section of FIG. 6 with the prior art cross-section of FIG. 3, in which the vertical binding elements comprise rigid beams having a depth of about 300 mm to 500 mm. This permits the use of longer cathode blocks 26 in the shell structure 12 of FIG. 6, as compared to that of FIG. 3.

Figure 13:
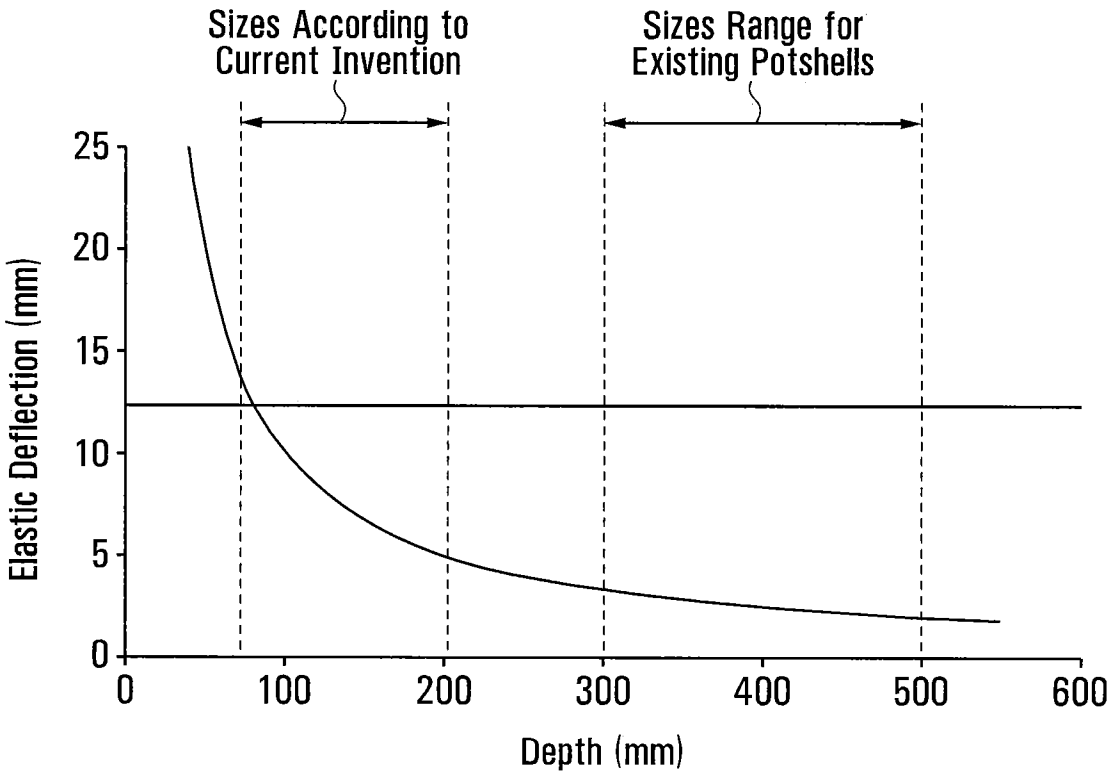
FIG. 13: Graph showing the relationship between elastic deflection and member depth, for a mild steel member 1 m in length.

To further illustrate the benefits of the vertical binding elements 60 according to the present embodiment, FIG. 13 shows the relationship between elastic deflection and member depth, for a mild steel member 1 m in length. For example, selecting a cantilever spring in the range of about 200-50 mm can increase the elastic deflection range of the compliant binding element by 150-600%, relative to conventional potshell stiffeners. In an embodiment, each of the compliant binding elements 60 extends between about 75 mm-150 mm in the transverse direction from the inside of the shell structure 12 over substantially the entire height of the compliant binding element 60.

The inventors have found minimum depth of the vertical binding elements 60 is limited by the requirement to achieve the operating load during heat-up of the lining. If the vertical binding elements 60 are excessively compliant, the initial lining expansion may be insufficient to reach the operating load. If this happens the reduction cell 10 will be at increased risk of metal infiltration during the early part of the campaign, before any chemical expansion has taken place. To overcome this limitation, the compliant binding elements 60 can be furnished with adjustment means that can be introduced between the free upper ends of the vertical binding elements 60 and the shell structure 12.

A first type of adjustment means is shown in FIGS. 4-8. As shown, the upper end of the compliant binding element 60 is shaped such that a slot 88 is provided between the sidewall 14 of shell structure 12 and an upper portion of the compliant binding element 60, including the upper end thereof. The slot 88 may include a sloped surface 92 which is outwardly sloped toward the upper end of the compliant binding element 60, thereby increasing the depth of the slot 88 at the upper end of the compliant binding element 60. At least partly received in the slot 88 is a wedge 90 that is fitted against the sloped surface 92, inbetween the upper end of the compliant binding element 60 and the outer surface of sidewall 14. The wedge 90 may be driven downwardly from above to increase the outward deflection of the upper end of the compliant binding element 60. The driving of the wedge 90 can be achieved by various means, for example by using a hammer, a portable hydraulic jack reacting against a suitable bracket, or any other suitable means. As shown in the close-up of FIG. 8, for example, a bracket 94 may be secured to the sidewall 14 above the upper end of the compliant binding element 60 and the wedge 90. The bracket 94 has a threaded aperture 96 which receives a screw 98, having a lower end which engages the upper (wide) end of the wedge 90. Threading the screw 98 into the aperture 96 will drive the wedge 90 downwardly into the slot 88, thereby increasing deflection of the upper end of the compliant binding element 60. Turning the screw 98 in the opposite direction will permit the wedge 90 to move upwardly in slot 88 to decrease deflection of the upper end of the compliant binding element 60.

As will be appreciated, the wedges 90 can be withdrawn over the campaign in response to the growth of the lining. This can facilitate expansion of the reduction cell 10 without encroaching on other constraints.

Figure 9:
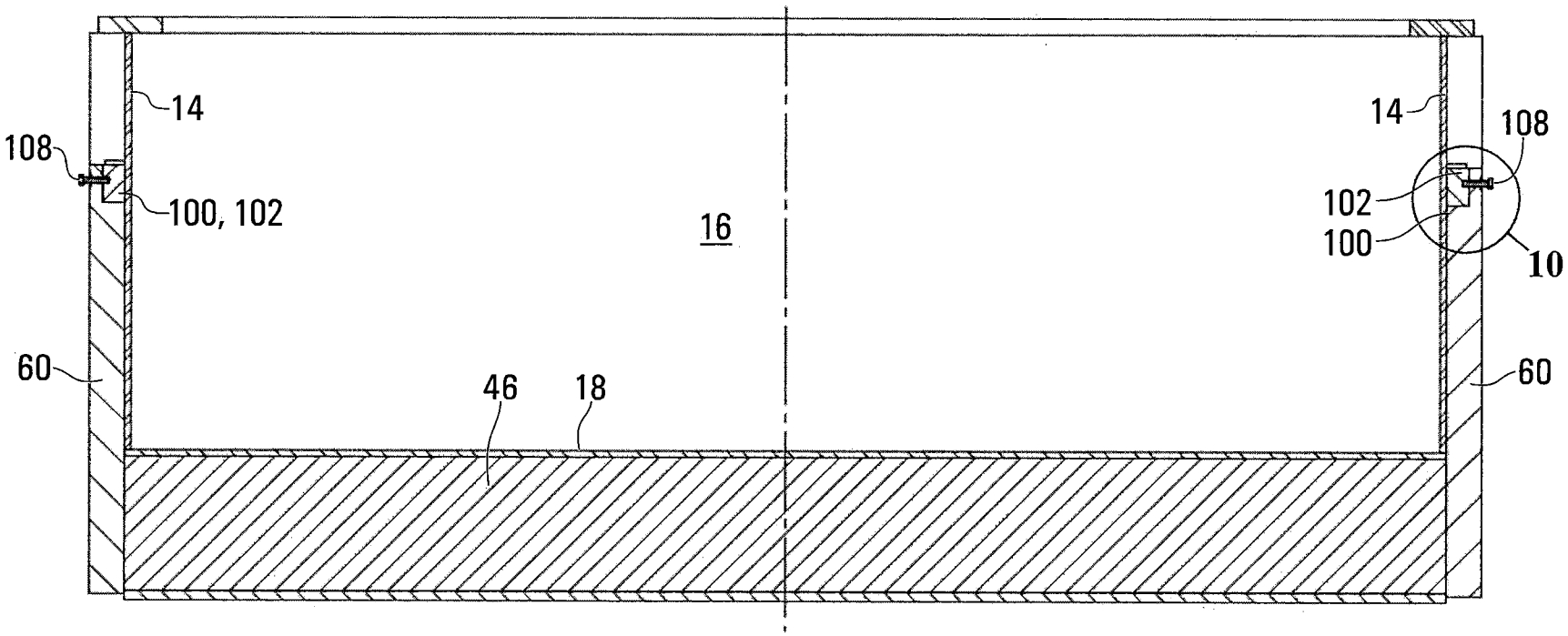
FIG. 9: Transverse cross-section of transverse bottom beams and compliant binding elements of the potshell of FIG. 4, including a second type of adjustment means.
Figure 10:
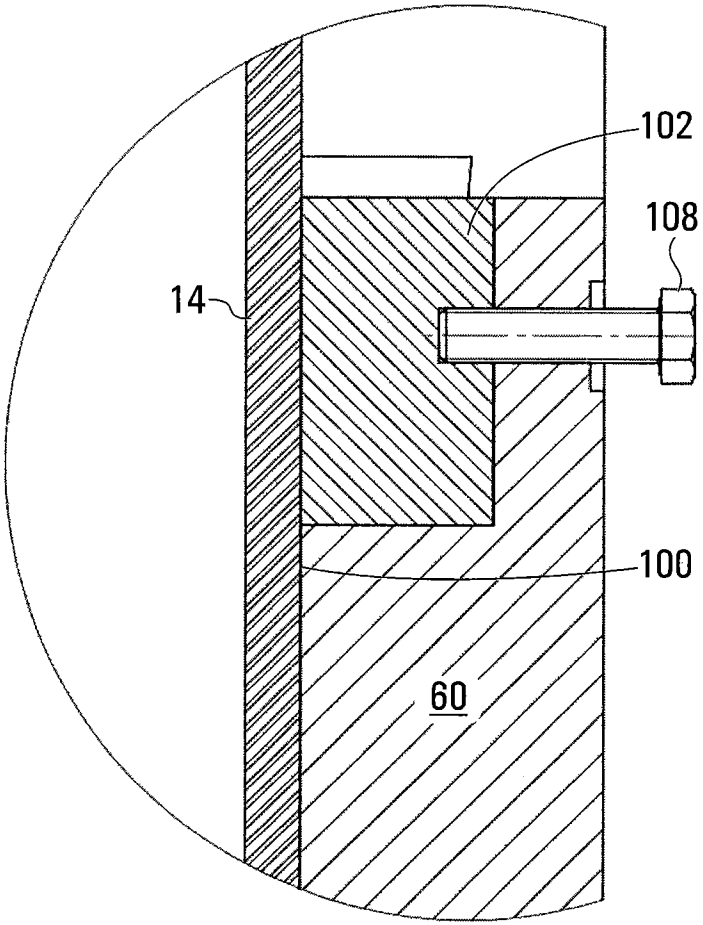
FIG. 10: Enlarged view of one of the compliant binding elements and adjustment means of FIG. 9.
Figure 11:
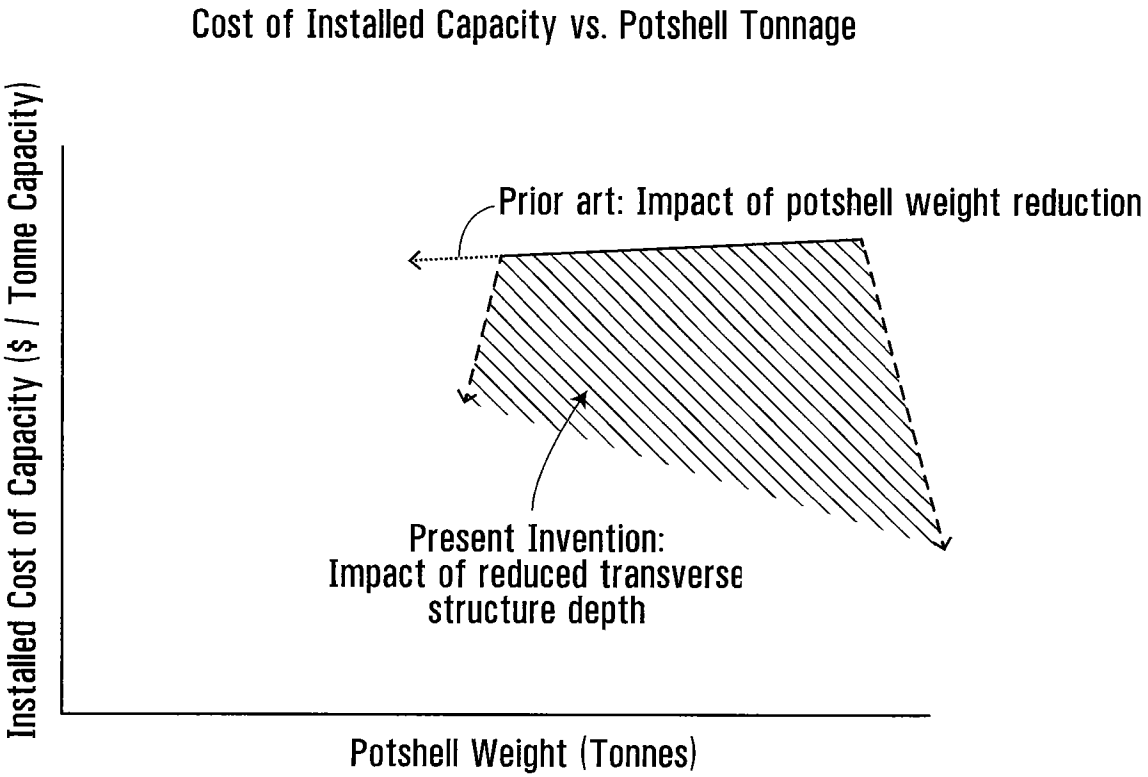
FIG. 11: Graph of Installed Cost of Capacity vs. Potshell Weight comparing prior art to present invention.

A second type of adjustment means is shown in FIGS. 9 and 10. As shown, the upper end of the compliant binding element 60 is reduced in depth so as to form a slot 100 between the upper end of the compliant binding element 60 and the outer surface of the sidewall 14. The slot 100 may have a rectangular shape as shown in FIGS. 9 and 10, and is sized and shaped to receive a pressure block 102. As can be seen from the enlarged view of FIG. 10, the upper end of the compliant binding element 60 has a threaded aperture 106 into which a screw 108 is threaded, an end of the screw 108 engaging the pressure block, the screw 108 being substantially perpendicular to sidewall 14. The pressure block 102 may have a recess 104 which aligns with the threaded aperture 106 and which receives the end of the screw 108, and which prevents the screw 108 from being dislodged during movements of the potshell 10 and lining. As will be appreciated, threading the screw 108 into the threaded aperture 106 will apply load to the pressure block 102, increasing the outward deflection of the upper end of the compliant binding element 60. Conversely, turning the screw 108 in the opposite direction will reduce the load on the pressure block 102, and decrease the outward deflection of the upper end of the compliant binding element 102.

The purpose of the adjustment means described above is to force additional deflection of the compliant binding element 60 after the lining has been heated to operating temperature, and after the carbon paste has been substantially baked, but before molten electrolyte or metal is introduced. The additional deflection provided by the adjustment means is sufficient to deflect the upper end of the compliant binding elements 60 by an amount, that when added to the expansion of the lining, will produce a reaction force in the compliant binding elements 60 equal to the desired operating load.

Therefore, providing the compliant binding elements 60 with the adjustment means described above allows the depth of the compliant binding elements 60 to be further reduced without reducing the performance of the aluminum reduction cell 10.

As discussed above, the profile (width and thickness dimensions) of the cantilever springs (i.e. compliant binding elements 60) can be varied along their length to achieve a greater or lesser compliance of the structure. Also, the compliant binding elements 60 can be attached, flexibly or rigidly, over parts of their length to the sidewall 14, while maintaining the freedom of movement of their upper ends, as may be suitable for a particular embodiment.

It should be clear to those skilled in the art that the compliant binding elements 60 as described herein can be used in combination with other spring elements, such as coil springs, disk springs, wave springs, leaf springs, or torsion bars to achieve greater compliance than is possible with the cantilever spring arrangement of the compliant binding elements 60 alone.

As will be appreciated, the embodiments described herein permit an increase of the capacity of an existing potline that is limited by current density on the surfaces of the anodes and cathodes. This benefit is illustrated by way of the following example:

A potline has 300 aluminum cells in two pot rooms, limited by current density, operating at 280 kA. The existing cells are of a conventional design having external and internal dimensions, and other characteristics according to Table 1.

TABLE 1

| | Original | With Low-Profile Potshells |
|---|---|---|
| Number of Cells | 300 | 300 |
| Pot-to-Pot Spacing (m) | 6.5 | 6.5 |
| Cell External Width (m) | 4 | 4 |
| Cell External Length (m) | 11 | 11 |
| Cathode Length | 2.8 | 3.1 |
| Stiffener Depth - Each Side (m) | 0.30 | — |
| Compliant Binding Depth - Each Side (m) | — | 0.15 |
| Endwall Structure Depth - Each Side (m) | 0.5 | 0.5 |
| Electrode Area (m^2) | 28 | 31 |
| Operating Current (kA) | 280 | 310 |
| Current Density (A/cm^2) | 1.00 | 1.00 |
| Capacity Increase | — | 11% |

As can be seen from the above table, the production capacity of the potline is increased by 11% by replacing the existing aluminum cells with low-profile cells having identical external dimensions and larger internal area. The increase in internal area is used to house larger anodes and cathodes. The current of the potline, and hence the production capacity, are increased without exceeding the current density limit.

It will be clear to those skilled in the art that in order to accommodate the larger anodes and cathodes, the superstructures will need to be modified.

It will also be clear to those skilled in the art that the increased production of aluminum may be associated with additional heat generation within the cell. The greater requirement for heat rejection can be met by mounting conductive cooling fins to the potshell exterior at the bath elevation, or increasing the convective heat transfer by other means, for example, forced air cooling.

It will also be clear, that the rectifiers, anode plant, rod shop, off-gas system, crane, pot tending machines, casthouse and other ancillaries may need to be modified, if they do not have sufficient extra capacity, to take full advantage of the improvements provided by the present invention.

It will also be clear to those skilled in the art that the present invention can be applied to the construction of new potlines, with the object of reducing the capital intensity of installed capacity.

Figure 1:
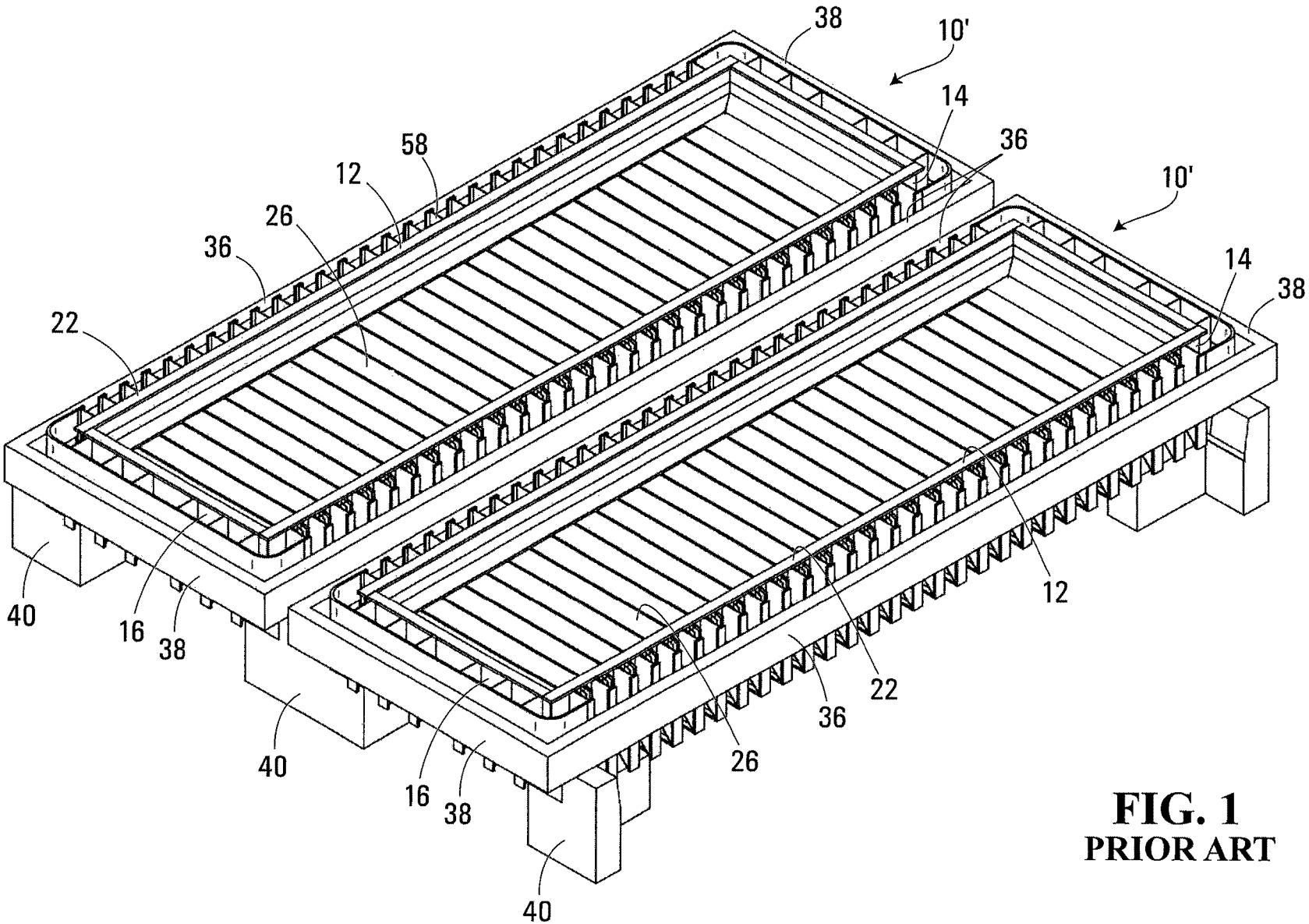
FIG. 1 PRIOR ART
FIG. 1: A pair of conventional potshells in their bays, showing supports and bus bars.

Prior art FIG. 1 illustrates a pair of prior art aluminum reduction cells 10' arranged side-by-side in a potline. The prior art reduction cells 10' include a number of elements which are similar or identical to the reduction cells 10 described above. Like reference numerals are used to identify these like elements of prior art reductions cells 10', and the above descriptions of these elements apply to the prior art figures unless indicated otherwise in the following description.

Also shown in FIG. 1 are longitudinal bus bars 36 extending along sidewalls 14 and spaced therefrom, and transverse bus bars 38 extending along the endwalls 16 and spaced therefrom. Although not shown in the drawings showing reduction cells 10, it will be appreciated that similar or identical bus bars 36, 38 will be included in the reduction cells 10 according to the invention. Also shown in FIG. 1 is the base structure of the prior art reduction cells 10'.

Figure 2:
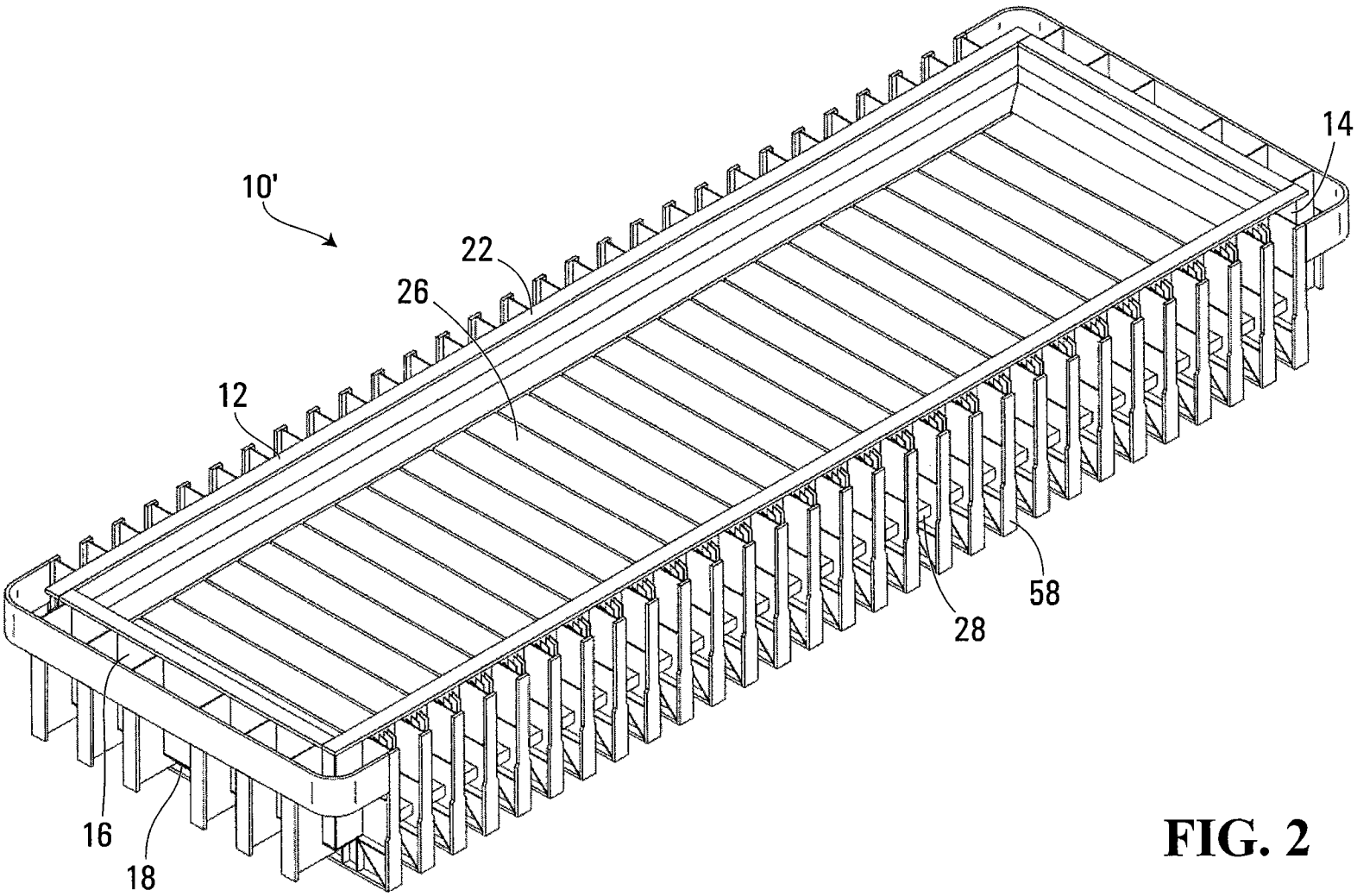
FIG. 2 Prior Art
FIG. 2: One of the conventional potshells of FIG. 1, shown without the busbars.

Prior art FIG. 2 illustrates one of the prior art aluminum reduction cells 10 with the bus bars removed, to more clearly show the rigid, vertical binding elements 58 provided along the sidewalls.

Figure 3:
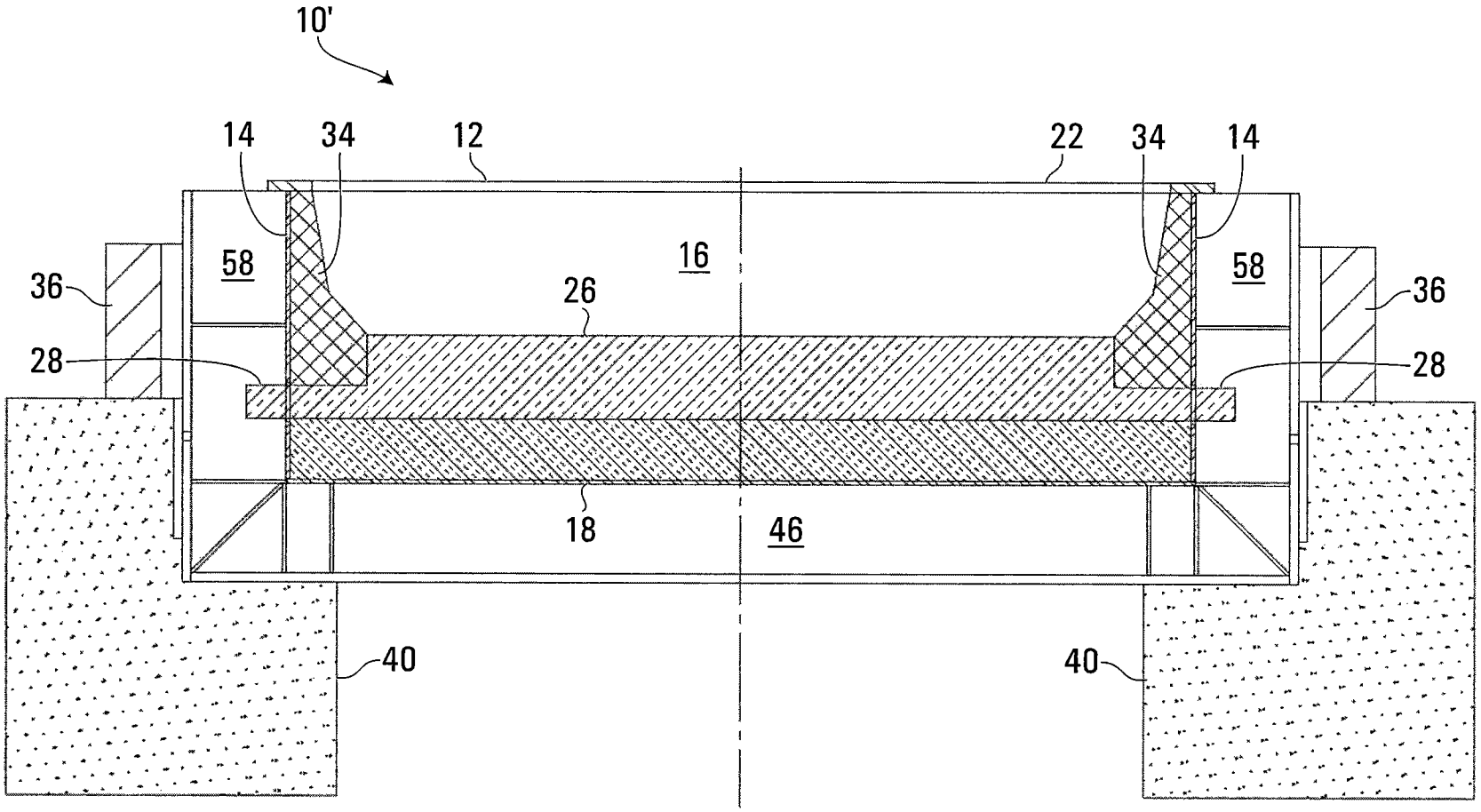
FIG. 3 Prior Art
FIG. 3: Transverse cross-section of the conventional potshell of FIG. 2, showing lining, and transverse structure.

Prior art FIG. 3 is a transverse cross section through one of the aluminum reductions cells 10', again showing the rigid, vertical binding elements 58, having a depth of 300-500 mm.

FIG. 12 shows the load-displacement characteristics for a stiff structure as shown in prior art FIGS. 1-3, and a compliant one in accordance with the present invention.

The above-described implementations of the present application are intended to be examples only. Alterations, modifications and variations may be effected to the particular implementations by those skilled in the art without departing from the scope of the application, which is defined by the claims appended hereto.

What is claimed is:

1. An aluminum reduction cell comprising:

(a) a shell structure including a pair of longitudinally extending sidewalls, a pair of transversely extending endwalls, a bottom wall, and an open top having an upper edge;

(b) a transverse support structure including a plurality of transverse bottom beams located under the shell structure and extending transversely between the sidewalls, each of the transverse bottom beams having a pair of opposed ends; and (c) a plurality of compliant binding elements fixed to the transverse support structure, each extending vertically along an outer surface of one of the sidewalls, for applying an inwardly directed force to said sidewall;

wherein the compliant binding elements are in the form of cantilever springs, each including:

a metal member having a lower end, which is secured to the transverse support structure; and a compliant, upper free end, which is movable inwardly and outwardly in response to expansion and contraction of the shell structure.

2. The aluminum reduction cell according to claim 1, wherein the ends of the transverse bottom beams do not substantially extend beyond the sidewalls of the shell structure.

3. The aluminum reduction cell according to claim 2, wherein the lower end of each of the compliant binding elements is rigidly secured to one of the ends of one of the transverse bottom beams.

4. The aluminum reduction cell according to claim 1, wherein each of the compliant binding elements extends vertically along an outer surface of one of the sidewalls.

5. The aluminum reduction cell according to claim 4, wherein each of the compliant binding elements is in contact with the outer surface of the sidewall along at least a portion of its length.

6. The aluminum reduction cell according to claim 1, wherein the compliant, upper free end of each compliant binding element is located at or below the upper edge of the shell structure.

7. The aluminum reduction cell according to claim 6, wherein at least some of the compliant binding elements are attached, rigidly or flexibly, over parts of their length, to the sidewall.

8. The aluminum reduction cell according to claim 6, wherein each of the compliant binding elements is of a length that allows for a majority of load transfer to the sidewalls to be directed to a top half of cathode blocks lining the bottom wall of the aluminum reduction cell.

9. The aluminum reduction cell according to claim 1, wherein each of the compliant binding elements comprises a metal plate.

10. The aluminum reduction cell according to claim 9, wherein the metal plate has a thickness, width and composition that allows:

the compliant, upper free end of each compliant binding element to be compliant; and each compliant binding element to maintain an inwardly directed compressive force on the shell structure during outward dilation and inward contraction of the shell structure.

11. The aluminum reduction cell according to claim 10, wherein the thickness and/or width of each of the compliant binding elements is varied along its length, with the upper end of the compliant binding element being reduced in width and/or thickness relative to the lower end, such that the upper end is more compliant than the lower end.

12. The aluminum reduction cell according to claim 1, wherein each of the compliant binding elements is designed in a manner that allows each of the compliant binding elements to receive:

during normal operation of the aluminum reduction cell, a first applied load; and in response to an expected reduction in process temperature, a second load the second load being greater than a minimum binding load, wherein the minimum binding load is a load at which forces opposing contraction of a lining of the aluminum reduction cell are overcome, thereby preventing formation of gaps in the lining during contraction in response to a thermal cycle comprising a deviation of about +/−100-150° C. from a normal operating temperature of the aluminum reduction cell.

13. The aluminum reduction cell according to claim 1, wherein the compliant binding elements comprise a mild or low-alloy steel.

14. The aluminum reduction cell according to claim 1, wherein the compliant binding elements have a depth of no more than about 200 mm.

15. The aluminum reduction cell according to claim 14, wherein the compliant binding elements have a depth from about 50 mm to about 200 mm.

16. The aluminum reduction cell according to claim 1, wherein the compliant binding elements are adjustable, and wherein the adjustability of the compliant binding elements is effected by disposition of an adjustment device between the upper ends of the compliant binding elements and the shell structure.

17. A method for improving the productivity of an aluminum reduction cell potline housed in an enclosure having a length and a width; wherein the potline comprises a plurality of existing aluminum reduction cells, each of said existing cells including an existing potshell and an existing support structure and having a first footprint defined by an area of the existing potshell and the existing support structure, wherein the existing potshell and the existing support structure each have a length extending across the width of the enclosure, and the length of the existing support structure is greater than the length of the existing potshell; the method comprising:

(a) removing one or more of said existing aluminum reduction cells from the potline; and (b) inserting one or more new aluminum reduction cells with a potshell according to claim 1 into the potline, wherein each of the new cells comprises a new potshell and a new base structure and is inserted into a space vacated by one of the existing cells;

wherein each of the new cells has a second footprint which is substantially the same as the first footprint, and wherein the new potshell has a length which is substantially the same as a length of the new support structure, such that the area of the new potshell is greater than an area of the existing potshell.

18. The method according to claim 17, whereupon increasing the width of the cells results in an increase in the operating current of the cells, so that the current density of the cathode remains substantially the same as before the capacity increase.

19. An aluminum reduction potline, comprising aluminum reduction cells connected in series, where the aluminum reduction cells are furnished with aluminum reduction cells according to claim 1.

20. The aluminum reduction cell according to claim 16, wherein:

the upper end of each of the compliant binding elements is shaped such that a slot is provided between the sidewall of the shell structure and an upper portion of the compliant binding element; and the adjustment device includes a wedge, wherein the wedge is at least partly received in the slot, and displaceable within the slot for adjusting the inwardly directed compressive force applied to the shell by the compliant binding elements.

21. The aluminum reduction cell according to claim 20 wherein the wedge is drivable downwardly within the slot to increase an outward deflection of the upper end of the compliant binding element.

22. The aluminum reduction cell according to claim 21 wherein the wedge is downwardly drivable by a screw threadingly received in an aperture of a bracket secured to the sidewall above the upper end of the compliant binding element and the wedge.

23. The aluminum reduction cell according to claim 20, wherein the slot is sized and shaped to receive a pressure block.

24. The aluminum reduction cell according to claim 23, wherein the upper end of the compliant binding element has a threaded aperture into which a screw is threaded, an end of the screw engaging the pressure block, wherein threading the screw into the threaded aperture applies a load to the pressure block and increasing outward deflection of the upper end of the compliant binding element.

25. The aluminum reduction cell according to claim 24, wherein the pressure block has a recess which aligns with the threaded aperture and receives the end of the screw.

* * * * *